US005673579A

United States Patent [19]

Hashimoto et al.

[11] Patent Number: 5,673,579

[45] Date of Patent: Oct. 7, 1997

[54] WELDED STEEL PIPE MANUFACTURING APPARATUS AND METHOD

[75] Inventors: Yuuji Hashimoto; Takaaki Toyooka; Motoaki Itadani; Susumu Itadani; Tsutomu Ide, all of Aichi, Japan

[73] Assignees: Kawasaki Steel Corporation; Kusakabe Electric & Machinery Co., Ltd., both of Japan

[21] Appl. No.: 662,434

[22] Filed: Jun. 10, 1996

[30] Foreign Application Priority Data

Jun. 12, 1995 [JP] Japan ..... 7-144298

[51] Int. Cl.[6] ..... B21D 39/02; B21D 51/23; B21B 37/00; B21B 37/08

[52] U.S. Cl. ..... 72/52; 72/14.4; 72/21.4

[58] Field of Search ..... 72/51, 52, 177, 72/178, 179, 181, 182, 14.4, 21.4; 228/147; 29/890.053

[56] References Cited

U.S. PATENT DOCUMENTS 1,163,975 12/1915 Cromwell ..... 72/100
4,697,446 10/1987 Yamamoto et al. ..... 72/52
4,747,289 5/1988 Nakamura ..... 72/52
4,776,194 10/1988 Chang ..... 72/52

FOREIGN PATENT DOCUMENTS 2-197329 8/1990 Japan ..... 72/178
6-328148 11/1994 Japan .

*Primary Examiner*—Lowell A. Larson
*Assistant Examiner*—Rodney Butler
*Attorney, Agent, or Firm*—Austin R. Miller

[57] ABSTRACT

In welded pipe manufacturing a steel strip is fed and bent by forming rolls into a pipe. A load detector is provided for a roll rotary shaft of each forming roll; a forming roll inclination adjustment device inclines the roll rotary shaft. The roll shaft load is measured to cause inclining of the rotary shaft counterclockwise or clockwise on a plane formed by the rotational axis of the forming roll and the advancing direction of the steel strip.

8 Claims, 10 Drawing Sheets

WELDED STEEL PIPE MANUFACTURING APPARATUS AND METHOD

BACKGROUND OF THE INVENTION

1. Field of the Invention

The present invention relates to an apparatus for manufacturing welded steel pipe using cage rolls or cluster rolls, and a related method.

2. Description of the Related Art

Steel pipe is produced by forming steel sheet or strip into a pipe and then welding the resulting seam. Various methods are used for the production of welded steel pipe. Conventional equipment utilizing cage rolls for the forming of steel strips is shown in FIGS. 12 and 13.

FIG. 12 is a plan view of a conventional forming apparatus that employs cage rolls, and FIG. 13 is a cross sectional view taken along line V—V in FIG. 12. Forming apparatus 100 includes a plurality of inner rolls 101, the widths of which are progressively reduced in the downstream direction, i.e., in the direction F as indicated by the arrow. Cage rolls 102 are arranged symmetrically along both sides of the apparatus, with the height adjusted according to forming conditions. The inner rolls 101 and the cage rolls 102 press internally and externally against a steel strip 1 as it is fed into the apparatus, gradually bending the steel strip 1 into a U shape and into an open pipe 1A.

As prior art for the above-described conventional cage rolls 102, Japanese Patent Laid-Open Publication No. 59-202122 discloses cage rolls having convex roll faces as shown in FIG. 15. Cage rolls having flat roll faces as shown in FIG. 16 are disclosed in Japanese Patent Laid-Open Publication No. 60-174216. Cage rolls having concave roll faces as shown in FIG. 17 are disclosed in Japanese Patent Laid-Open Publication No. 3-174922. These cage rolls may be employed for the production of pipes of various sizes.

Another known welded steel pipe manufacturing apparatus used in sequential roll forming processes comprises a cluster roll arrangement as shown in FIG. 14. The forming apparatus 110 in FIG. 14 comprises first breakdown rolls 111, which are arranged in a plurality of stages and comprise paired upper and lower horizontal rolls. Downstream of first breakdown rolls 111 are second breakdown rolls 112, which comprises a roll set of an upper and a lower horizontal roll. Cluster rolls 113 constitute paired right and left vertical rolls arranged in a plurality of stages and positioned with the second breakdown rolls 112 sandwiched between them. Fin pass rolls 114 utilize sequentially positioned and paired upper and lower horizontal rolls arranged in a plurality of stages. Steel strip 1 is gradually bent and formed into a cylindrical pipe 1A while being fed through this line. As disclosed in Japanese Patent Laid-Open Publication No. 62-158528, cluster rolls 113 used in this apparatus have the same curvature or have an involute cross section based on a polygon.

If rolls that have a convex roll face or a flat face, as is disclosed in the above-described Japanese Patent Laid-Open Publication No. 59-202122 and Japanese Patent Laid-Open Publication No. 60-174216, are used as cage rolls for the cage roll forming apparatus 100 shown in FIGS. 12 and 13, the straight line portion of a formed pipe that contacts the rolls will be flattened, thereby deteriorating pipe roundness and degrading the shape quality.

If rolls having a concave roll face as taught in the above-described Japanese Patent Laid-Open Publication No. 3-174922 are used as cage rolls in the cage roll forming apparatus 100, pipe flattening can be prevented and the roundness of the pipe can be improved. However, when steel, such as stainless steel, is shaped using these rolls, the rolls tend to stick to the steel. Thus, the sticking of the rolls creates roll marks on the surface of the pipe, thereby making it difficult to achieve a quality mirror finish on the pipe.

If rolls are lubricated with a soluble oil or the like, the sticking of the rolls is reduced and the transfer of roll marks is eliminated, thus resolving the problem concerning the quality of the appearance. However, if the rolls are lubricated for a pipe forming process involving a material having low weldability, such as stainless steel, the welding process cannot be stably performed, and weld strength may be deteriorated.

In the forming apparatus 110 shown in FIG. 14, having the cluster rolls 113 arranged as shown, roll marks readily occur when stainless steel or the like is formed without lubrication. Further, in both the conventional forming apparatus 100 (FIGS. 12 and 13) utilizing the cage rolls 102, and the conventional forming apparatus 110 (FIG. 14) employing the cluster rolls 113, the steel strip being formed tends to roll disadvantageously in the circumferential direction.

Japanese Patent Laid-Open Publication No. 6-328148 seeks to solve these problems by inclining the rotational axes of the cage rolls to reduce upward or downward sliding, which occurs when a steel strip contacts the cage rolls as it is passed through. More specifically, the rotational axes of the cage rolls are inclined to create an incline angle of 5° or less for the steel strip being formed, relative to the production path of the steel strip. In practice, however, it is difficult to detect the contact point between the cage roll and the steel strip during the mill operation, and the incline angle for the steel strip at the cage roll contact point cannot be measured accurately. Therefore, there is no assurance that the sliding of the steel strip will be reduced relative to the cage rolls. Further, this technique does not adequately prevent roll marks.

SUMMARY OF THE INVENTION

It is, therefore, an object of the present invention to provide an apparatus for manufacturing welded steel pipes that stabilizes the forming process to ensure high weldability and excellent product appearance, and to provide a method for accomplishing the same.

The apparatus according to the invention takes advantage of input from one or more load detectors provided for the rotary shafts of some or all of the forming rolls. A forming roll inclination adjustment device is provided, which causes the rotary shaft of one or more of the forming rolls to be selectively angularly adjusted. A controller for the inclination adjustment device is also provided.

Normally, the forming rolls are located on both sides of the steel strip to define a pipe production line. The method of the invention involves measuring existing load on a rotary shaft of a forming roll of such a pipe forming apparatus.

The rotary shaft of the forming roll is caused to shift angularly counterclockwise or clockwise substantially within a plane that is formed by the rotational axis of the forming roll and the pipe production line. The inclination or angular adjustment is effected in response to forming roll axis measured load to minimize the total load, which remarkably stabilizes the forming process and provides significantly improved weldability and excellent product appearance.

Other aspects of the present invention will become readily apparent from the following detailed explanation.

DETAILED DESCRIPTION OF THE INVENTION

Figure 5:
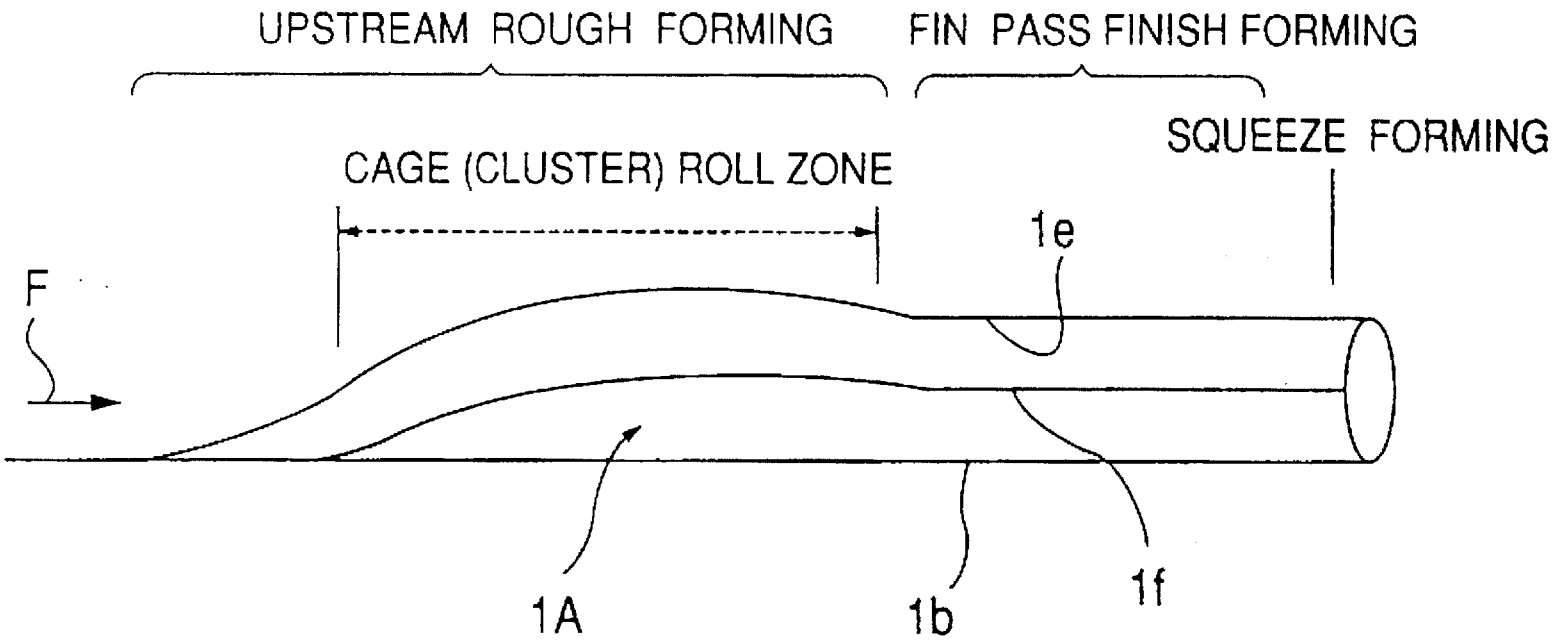
FIG. 5 is a diagram showing an elevation change, at an arbitrary point in the circumferential direction, of an open pipe being formed in accordance with the present invention.

FIG. 5 is a diagram of an open pipe 1A, viewed from the side during a forming process. FIG. 5 shows that the height is changed at arbitrary points in the circumferential direction of the open pipe 1A, such as an edge portion 1*e* and a side portion 1*f*. It should be noted that in FIG. 5 the height of a bottom line 1*b* of the pipe is constant. As is apparent from FIG. 5, in the upstream zone for rough forming where cage rolls or cluster rolls (hereinafter commonly referred to as cage rolls) are arranged, the height at arbitrary points in the circumferential direction of the open pipe 1A tends to increase as mid-stream is approached, peak at the mid-stream point, and then taper downstream from the mid-stream point.

Figure 8:
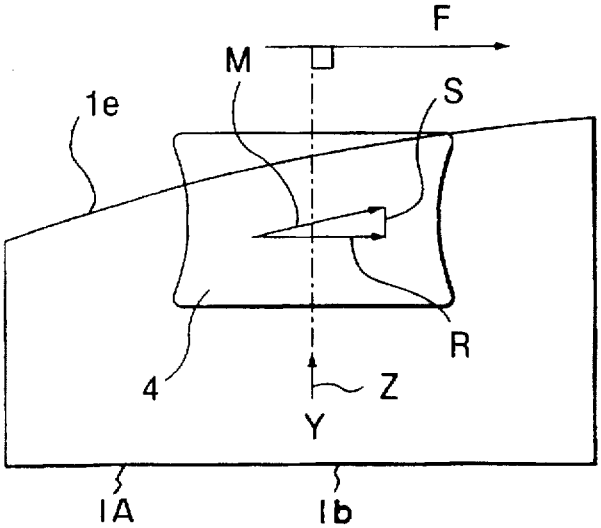
Fig. 8 PRIOR ART
FIG. 8 is a diagram showing cage rolls set in accordance with a conventional method.

As is shown in FIG. 8, rotational axis Y of a conventional cage roll 4, when extended in the Z direction, is perpendicular to the line direction F. This causes the rotational direction R of the cage roll 4 at the strip-contact portion to be parallel to the line direction F. It is also clear that the rotational direction R differs from the direction M of the steel strip advancement at the strip-contact portion. Therefore, when the steel strip contacts and passes through the individual cage rolls 4, the steel strip slides upward and downward along the roll face, thereby generating upward and downward friction forces S between the cage rolls 4 and the steel strip. When steel strip that tends to stick to the rolls, such as stainless steel strip, is to be formed into a pipe through non-lubricated rolls, the upward and downward friction forces S increase between the cage rolls 4 and the steel strip, thus causing roll marks. Since friction S acts as a force that presses the steel strip upward and downward, the steel strip may be rolled excessively when the force exerted by the right and left rolls becomes unbalanced from this meandering of the steel strip.

We have discovered a technique that surprisingly reduces the friction forces S. This is described in further detail hereinafter, with reference to specific embodiments selected for illustration in the drawings, without intending to limit or to define the scope of the invention as defined in the appended claims.

Figure 6:
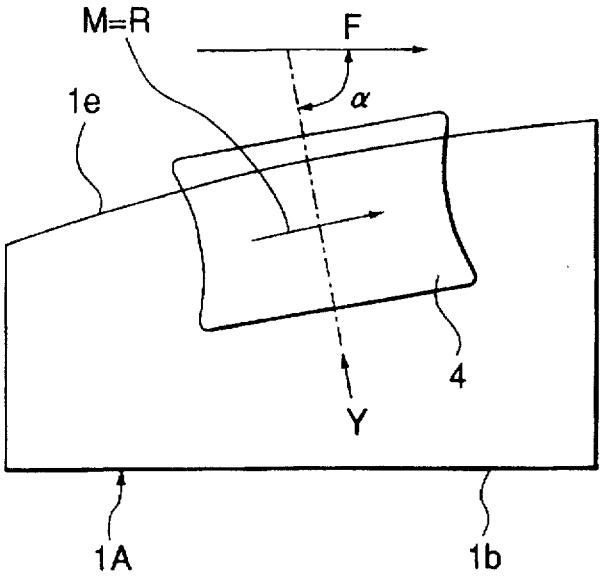
FIG. 6 is a diagram showing an embodiment of the present invention wherein cage rolls are inclined counterclockwise.
Figure 7:
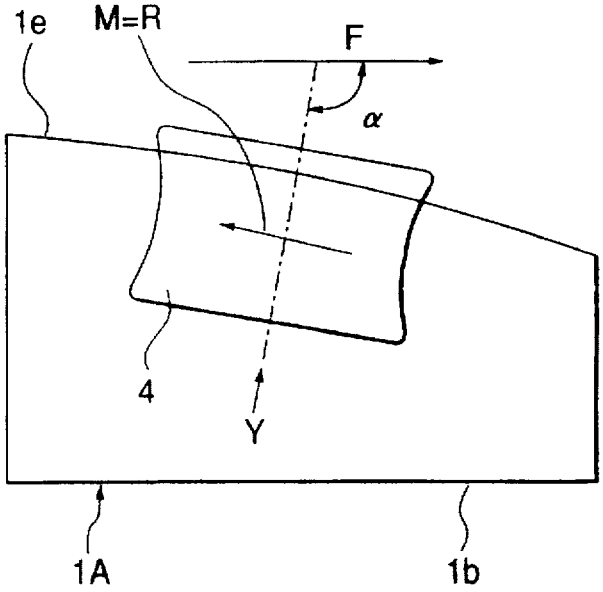
FIG. 7 is a diagram showing an embodiment of the present invention wherein cage rolls are inclined clockwise.

More specifically, according to the method of the present invention, a load detector is attached to the upper face and the lower face of the cage roll 4 and detects a load P (upward and downward friction forces S) that acts along the axial direction of the cage roll 4 (hereinafter referred to as the roll axial direction load P). In order to reduce the roll axial direction load P, the rotational axis Y of the cage roll 4 is angularly adjusted counterclockwise, as is shown diagrammatically by the arrow in FIG. 6, or clockwise, as in FIG. 7, along a plane formed by the rotational axis Y and the line direction F. As a result, the steel strip advancing direction M and the rotational direction R of the cage roll 4 can be arranged to substantially correspond to each other at the contact portion, as indicated by the arrows M=R in FIGS. 6 and 7. Thus, the upward and downward sliding that tends to be created when the steel strip passes through the roll contact portion of the process is significantly reduced. As a result roll marks are prevented even when the steel strip being formed is stainless steel. Moreover, unwanted circumferential rolling of the steel strip seldom occurs.

Figure 9:
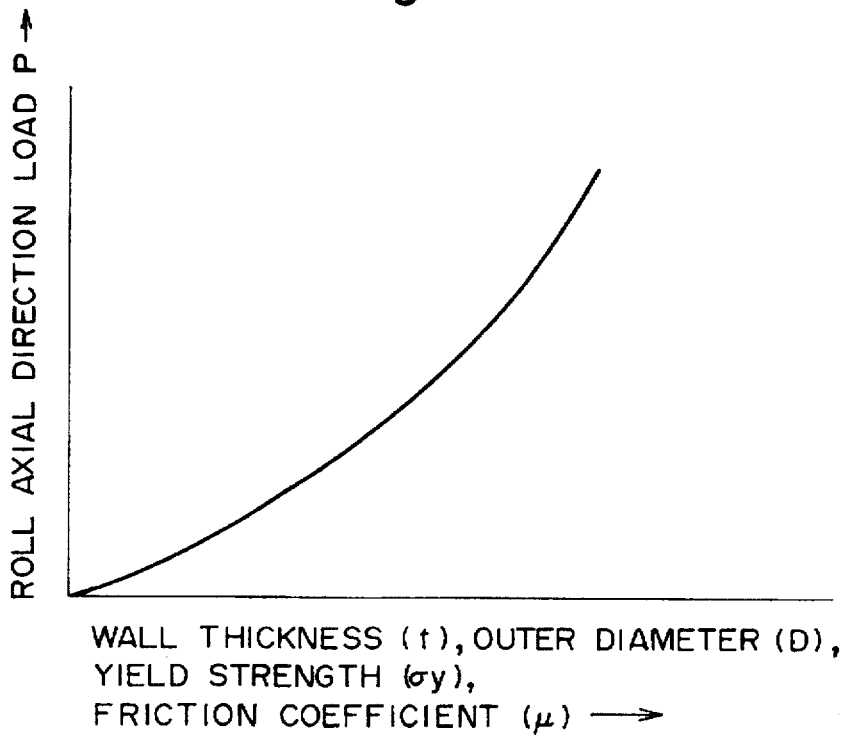
FIG. 9 is a graph showing the relationship between physical characteristics of a steel strip and the load in the roll axial direction.
Figure 10:
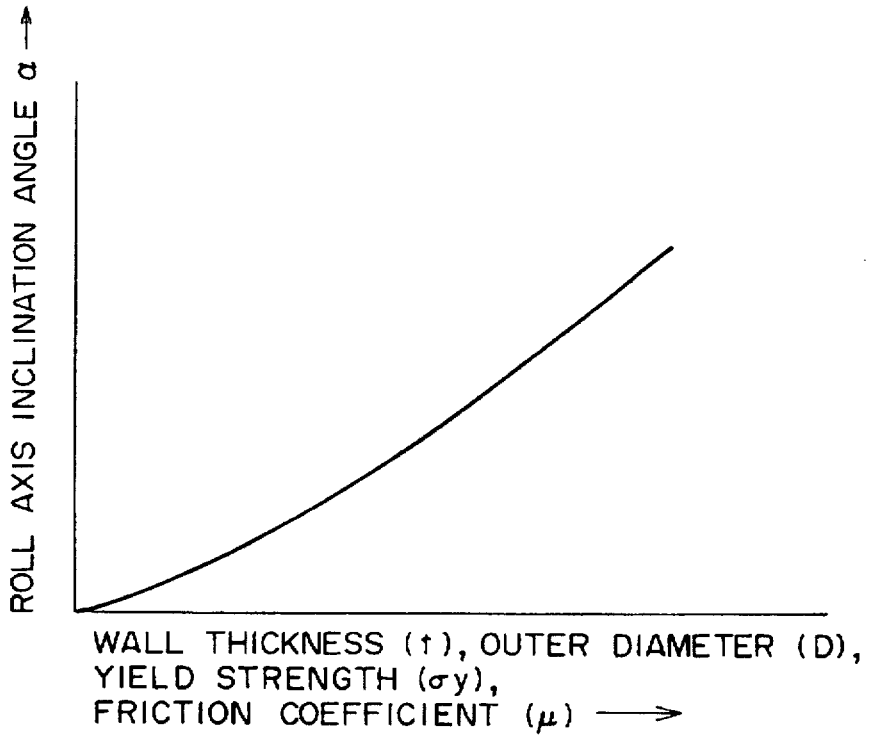
FIG. 10 is a graph showing the relationship between physical characteristics of a steel strip and the roll axis inclination angle.

As is shown in FIG. 9 of the drawings, as the roll axial direction load P increases the wall thickness of steel strip t, the pipe outer diameter D, the yield strength $\sigma_y$ and the friction coefficient $\mu$ also increase. In order to reduce the roll axial direction load P to a value approaching zero, the inclination angle $\alpha$ of the roll axis must increase as the above-described physical characteristics of the steel strip or sheet increase, as is shown in FIG. 10, in which P is zero along the plot line. Since the roll axis direction load P differs in production practice with the use of various pass schedules, the length of the line, the number of stands and the distribution of the steel strip bending angles, it is necessary for the inclination angle of the rotary shaft to be adjusted according to the particular pass schedule. As described above, although the roll axis direction load P differs depending on the steel strip used for pipe forming and pass schedules, only the inclination angle of the roll axis needs to be adjusted to reduce the axial direction load P to a value approaching zero.

One practical embodiment of the present invention will now be described in detail while referring to the accompanying drawings. The description is not intended to limit the scope of the invention as defined in the appended claims.

Figure 1:
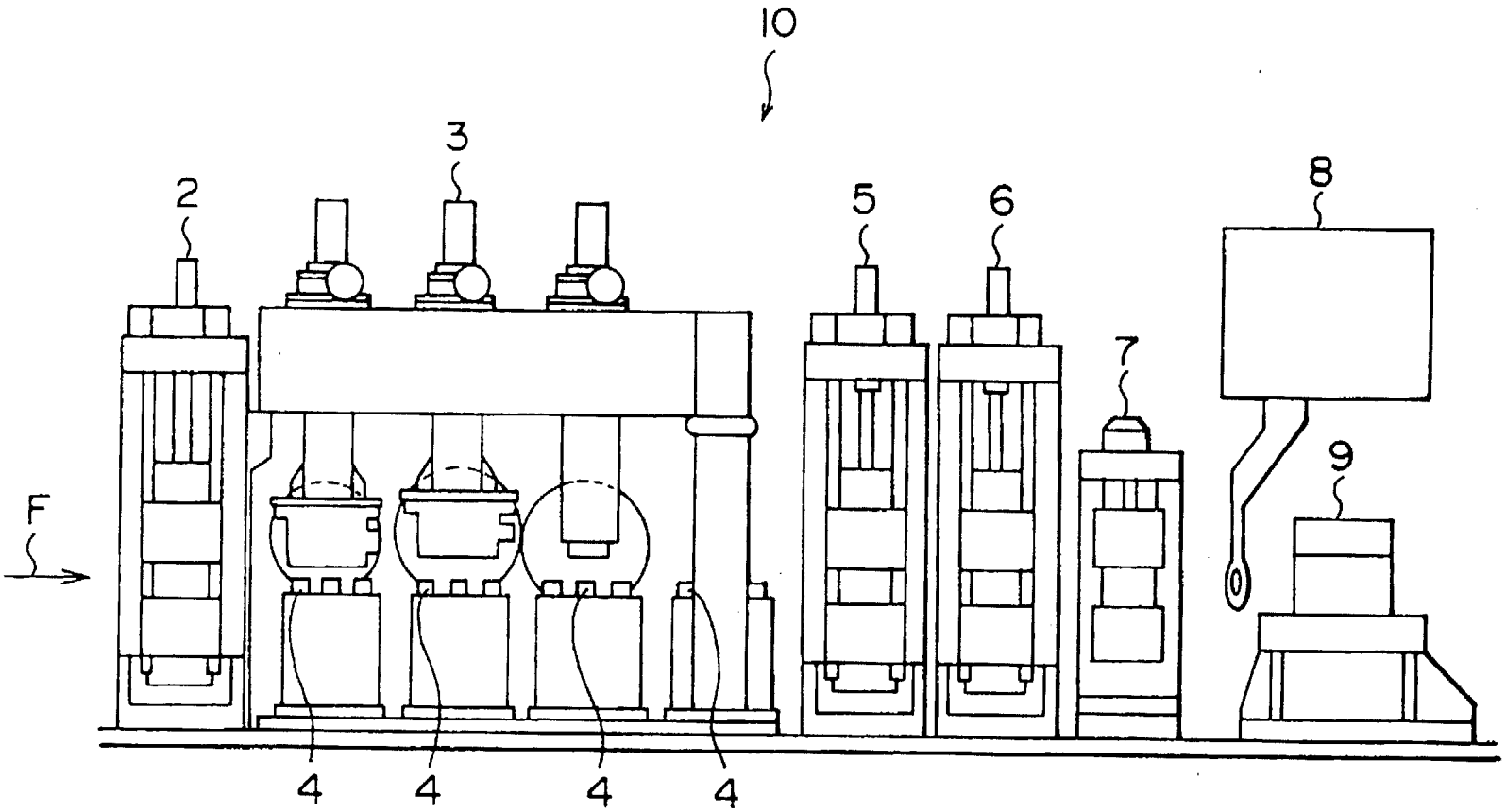
FIG. 1 is a side view of a welded pipe manufacturing apparatus in accordance with the present invention.

FIG. 1 is a side view of a welded pipe manufacturing apparatus in accordance with the present invention. In FIG.

1, reference numeral 2 denotes edge bend rolls; 3, inner rolls; 4, cage rolls which are arranged along both sides of the inner rolls 3; 5, first fin pass rolls; and 6, second fin pass rolls. Reference numeral 7 denotes rotary seam guide rolls; 8, a high frequency welding machine; and 9, squeeze rolls.

Edge bend rolls 2, inner rolls 3, first and second fin pass rolls 5 and 6, and rotary seam guide rolls 7 each have an upper roll and a lower roll. Cage rolls 4 and squeeze rolls 9 each have a left roll and a right roll.

Figure 12:
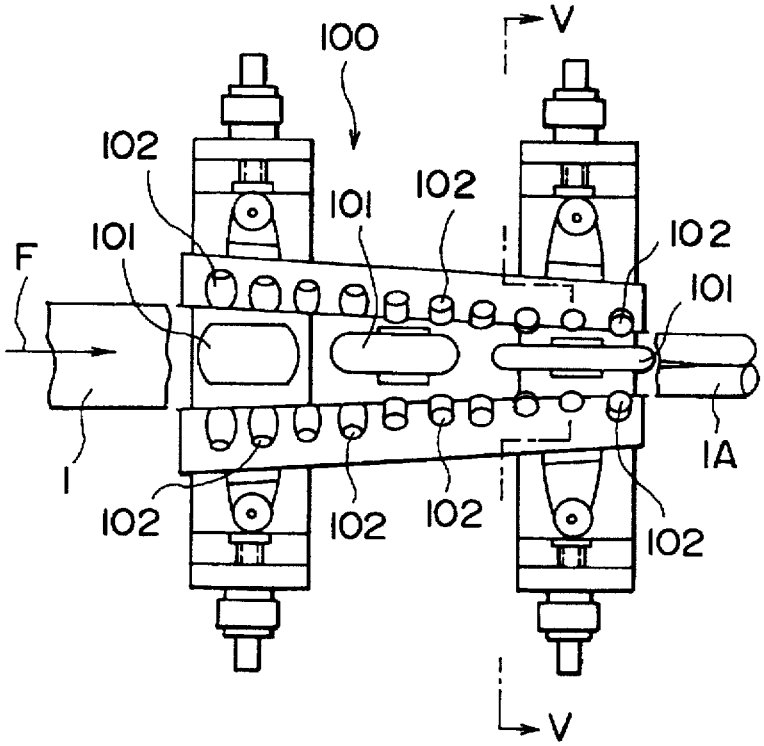
Fig. 12 PRIOR ART
FIG. 12 is a plan view of a conventional cage roll forming apparatus.
Figure 13:
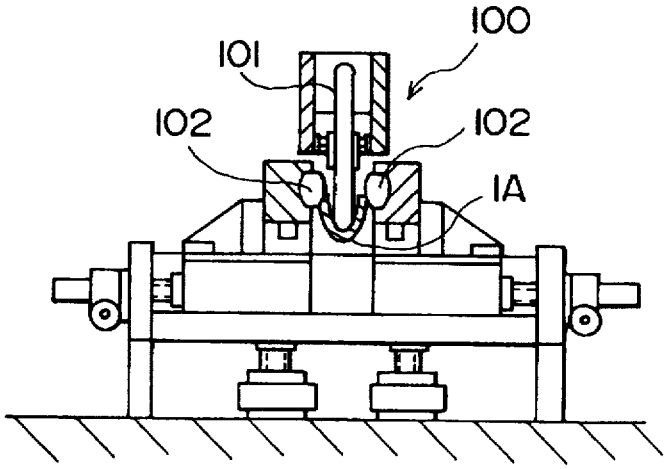
Fig. 13 PRIOR ART
FIG. 13 is a cross-sectional view taken along line V—V in FIG. 12.
Figure 14:
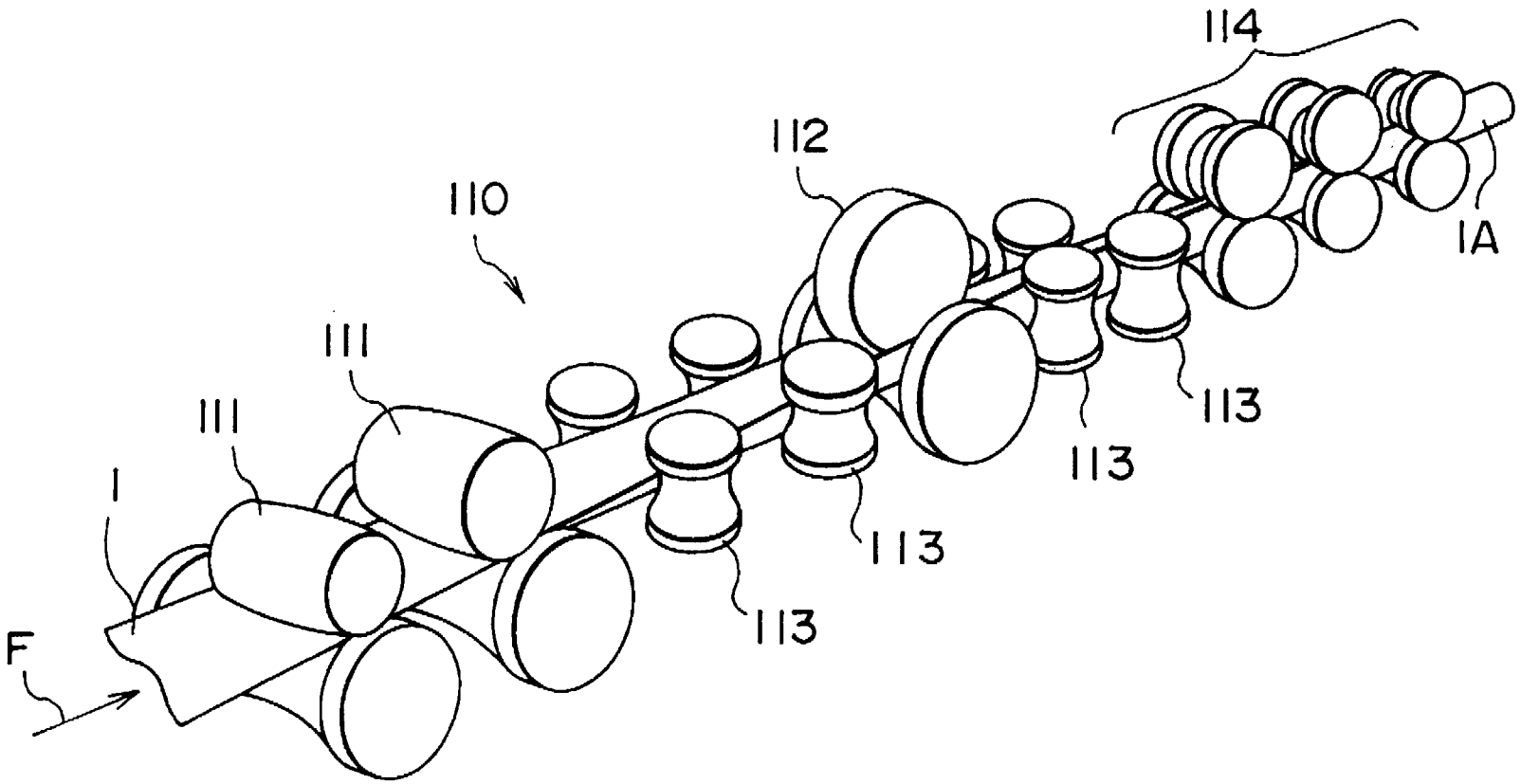
Fig. 14 PRIOR ART
FIG. 14 is a perspective view of a forming apparatus that employs conventional cluster rolls.
Figure 15:
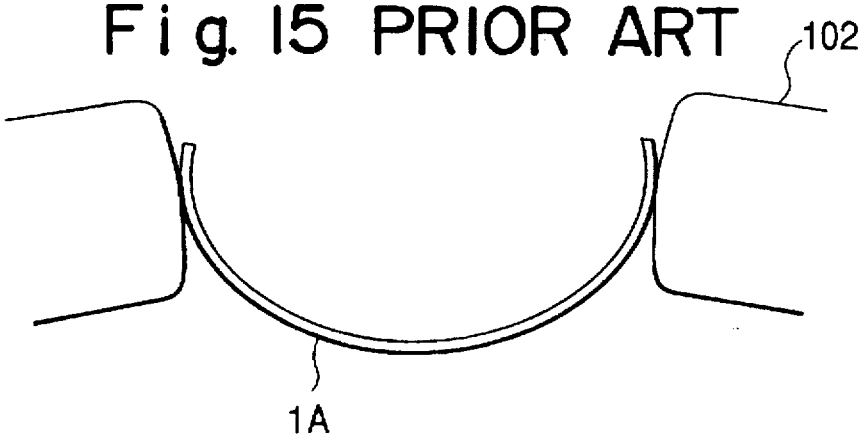
Fig. 15 PRIOR ART
FIG. 15 is a diagram showing a forming process utilizing cage rolls that have conventional convex roll faces.
Figure 16:
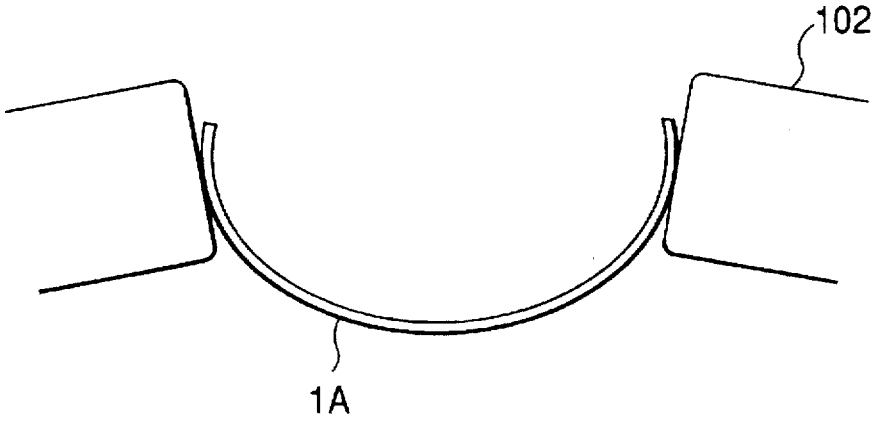
Fig. 16 PRIOR ART
FIG. 16 is a diagram showing a forming process utilizing cage rolls that have conventional flat roll faces.
Figure 17:
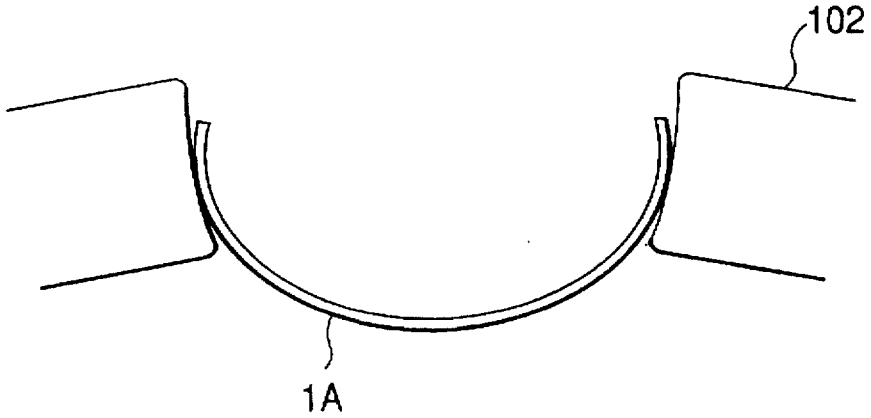
Fig. 17 PRIOR ART
FIG. 17 is a diagram showing a forming process utilizing cage rolls that have conventional concave roll faces.

When the thusly arranged forming apparatus 10 in accordance with the present invention is employed to form an open pipe during the manufacture of a welded steel pipe, a steel strip 1 (FIG. 12) is fed in a direction indicated by arrow F in FIG. 1. First, edge portions 1*e* (FIG. 5) of an open pipe are bent by the edge bend rolls 2 of FIG. 1. Then, the boundaries of the steel strip between side portions 1*f* (FIG. 5) and bottom portion 1*b* (FIG. 5) are pressed down by the inner rolls 3 of FIG. 1. Side pressure is applied to edge portions 1*e* and side portions 1*f* by the cage rolls 4 of FIG. 1 to form an open pipe 1A (FIG. 5) having an oval cross section.

The open pipe 1A is formed under the pressure exerted by the first and the second fin pass rolls 5 and 6 of FIG. 1. The fin pass rolls 5 and 6 extend side portions 1*f* and bend (or bend back) edge portions 1*e* and the boundaries to form the open pipe 1A into as round a shape as possible. The position of the open pipe 1A to be welded is adjusted by the rotary seam guide rolls 7 of FIG. 1. A welding current is supplied by the high frequency welding machine 8 of FIG. 1 to melt the steel strip at a seam formed by the edge portions 1*b*, and upset welding is performed at the seam by squeeze rolls 9.

For this process, twelve cage rolls 4 are arranged on each side, and the inclinations of the rolls can be independently adjusted counterclockwise or clockwise on a plane that is formed by the rotation axis of each roll and the line direction F.

Figure 2:
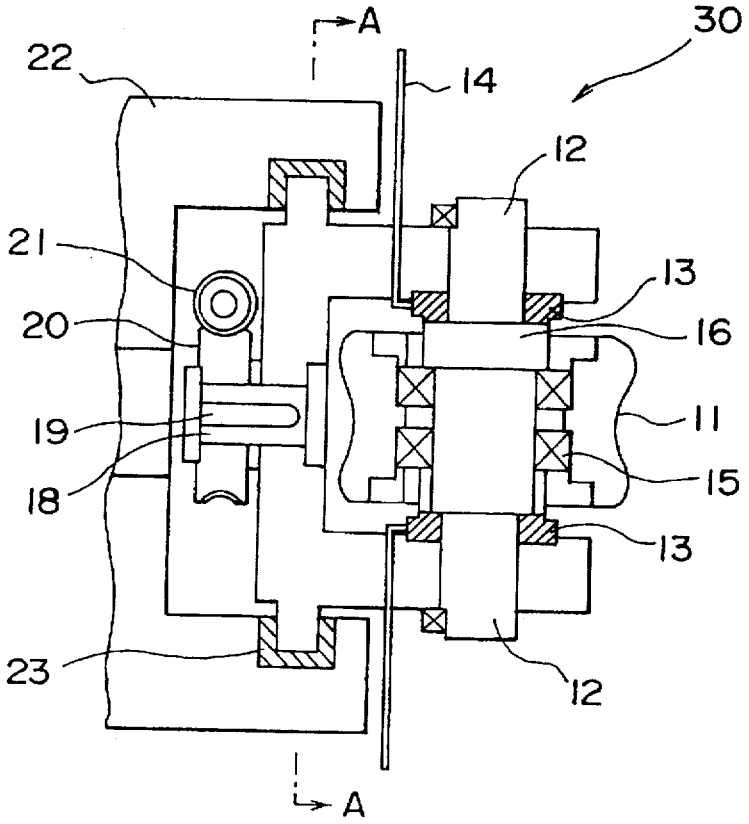
FIG. 2 is a cross-sectional side view of a cage roll inclination adjustment device in accordance with the present invention.
Figure 3:
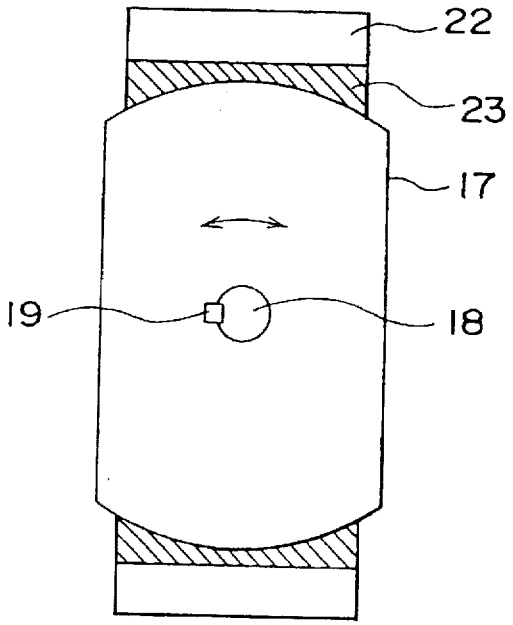
FIG. 3 is a cross-sectional front view taken along line A—A in FIG. 2.

The FIG. 1 structure and operation will be explained in further detail while referring to FIGS. 2 and 3 of the drawings. FIG. 2 is a side cross sectional view of a cage roll inclination adjustment device 30, and FIG. 3 is a front cross sectional view taken as indicated by the lines and arrows A—A which appear in FIG. 2.

The cage roll inclination adjustment device 30 has a load detector 13, which is fitted around a roll rotary shaft of a roll body 11, and a support metal fitting 17, into which is fitted the roll rotary shaft 12.

The load detector 13 is fixed by the roll bearings 15 and a block 16 to both ends of the roll rotary shaft 12, allowing the roll body 11 to be rotated. A load signal in the axial direction that is detected by the load detector 13 is transmitted to a controller 31 via a signal cable 14.

The support metal fitting 17 is attached to and moves with a rotary shaft 18 which is fixed at one end of fitting 17 by a key 19. Rotary shaft 18 is rotated by a worm 20, a worm gear 21 and a motor 24 (FIG. 4), and is supported by an arc guide 22 and a sliding bearing 23.

Figure 4:
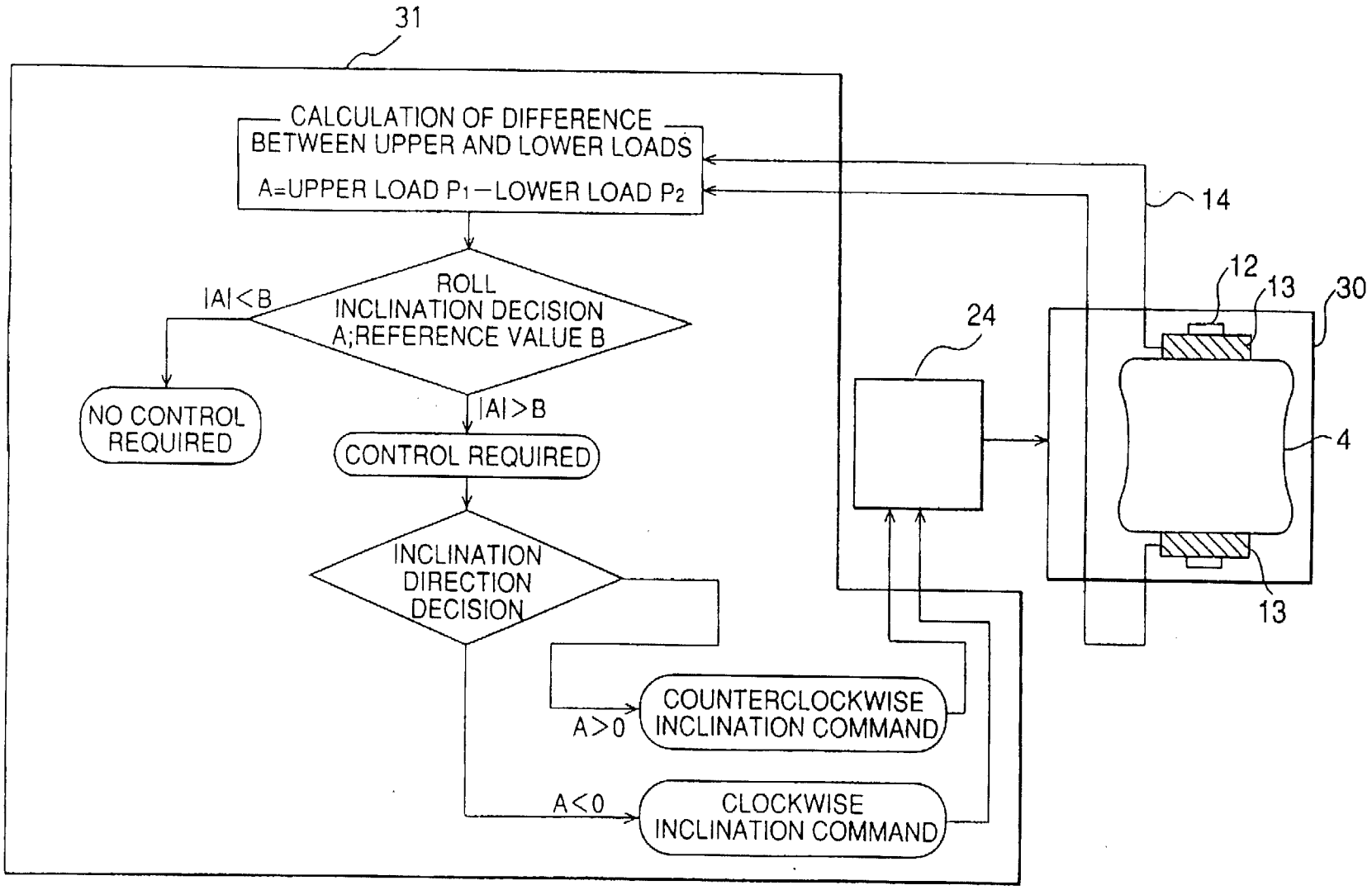
FIG. 4 is a diagram depicting a controller for the cage roll inclination adjustment device of the present invention.

The inclination of the cage rolls 4 will now be explained with reference to FIG. 4 which is an explanatory diagram showing the controller 31 of the cage roll inclination adjustment device 30.

The load detector 13 that is located around the roll rotary shaft 12 of the upper face of the cage roll 4 measures an upper load $P_1$. The load detector 13 that is located on the lower face of the cage roll 4 measures a lower load $P_2$. Measurement signals for both loads are transmitted to the controller 31 via the signal cable 14. The controller 31 in a manner known per se calculates a value A, representing the difference between loads $P_1$ and $P_2$ ($A=P_1-P_2$), and compares the value A with a reference value B that has been programmed in advance. When $|A|$ exceeds B, a cage roll inclination command is issued. When $|A|$ is greater than B and $A>0$, a command for counterclockwise inclination viewed from the mill operation side is issued. When $|A|$ exceeds B and $A<0$, a command for clockwise inclination viewed from the mill operation side is issued. In response to the inclination command the motor 24 rotates in the designated amount and the cage roll 4 is inclined to the optimum angle.

Figure 11:
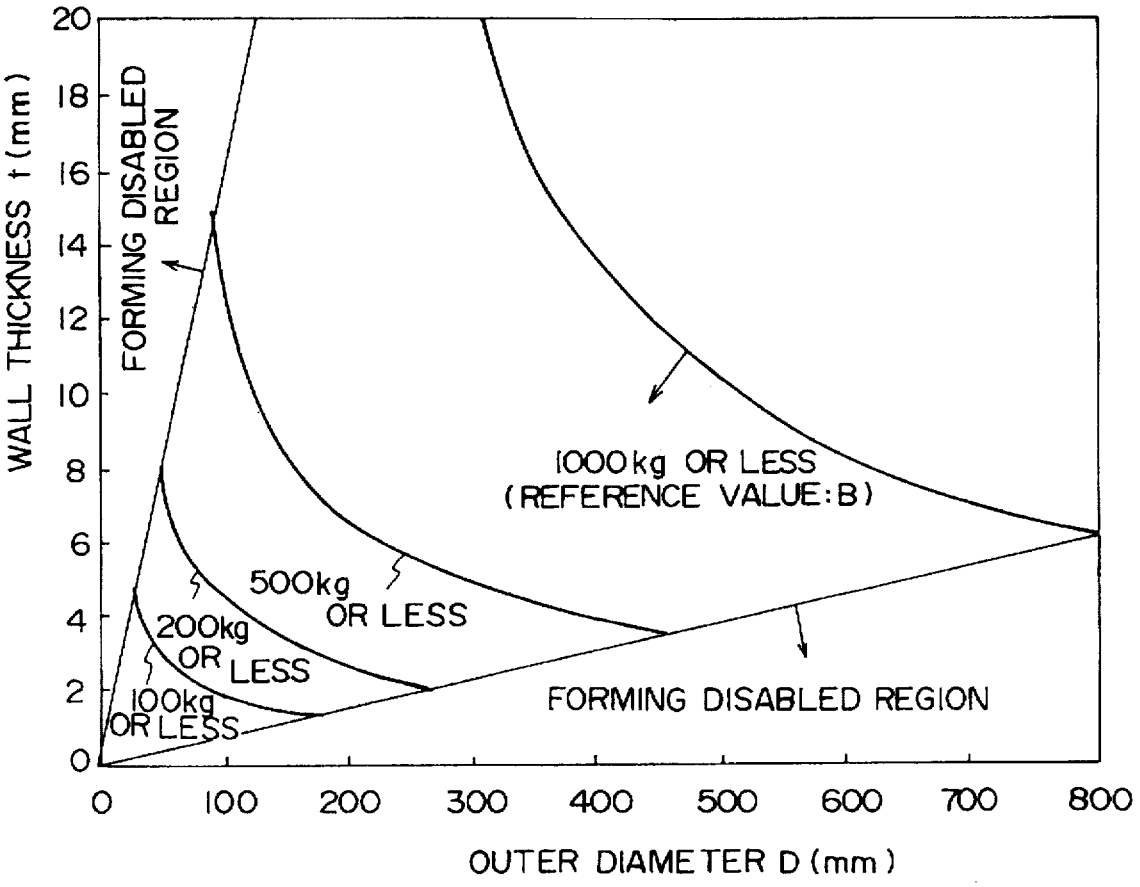
FIG. 11 is a graph showing the relationship between a value B representing the difference between the loads placed on two rolls in the axial direction, the outer diameter of a steel pipe, and the wall thickness.

Since the corrective effect is reduced if the reference value B is too large, it is preferable that the reference value B be set to an adequate value in consonance with the outer diameter D and the wall thickness t of a steel pipe. A standard for setting the reference value B is shown in FIG. 11. In FIG. 11, it is preferable that the reference value B be set to 100 kg or less for a small-diameter pipe, and to 1000 kg or less for a 20 inch class mid-diameter pipe.

Means for adjusting the extension and retraction of rolls and means for adjusting the ascent and descent of rolls are conveniently additionally provided for cage roll 4, as means for coping with different outer diameters.

EXAMPLES

A welded steel pipe manufacturing apparatus as shown in FIG. 1 was employed to form SUS430 steel pipe having an outer diameter of 60.5 mm and a wall thickness of 3.0 mm at a processing speed of 100 m/min with no lubrication. The apparatus utilized cage rolls, to each of which was attached one of the cage roll inclination adjustment devices shown in FIGS. 2, 3 and 4. The results of the processings are shown in Table 1.

TABLE 1

| | Cage roll No. | Reference value B (kg) | A(kg) $P_1-P_2$ | Cage roll inclination angle α | Occurrence of roll marks | Remarks |
|---|---|---|---|---|---|---|
| Examples of the Invention | 1 | 100 | 37 | 90.00 | No | No cage roll inclination |
| | 2 | 100 | 86 | 90.00 | No | No cage roll inclination |
| | 3 | 100 | 6 | 89.57 | No | |
| | 4 | 100 | 8 | 89.20 | No | |
| | 5 | 100 | 23 | 88.96 | No | |
| | 6 | 100 | 35 | 88.84 | No | |
| | 7 | 100 | 20 | 89.05 | No | |
| | 8 | 100 | 5 | 89.88 | No | |
| | 9 | 100 | 0 | 90.02 | No | |

TABLE 1-continued

| | Cage roll No. | Reference value B (kg) | A(kg) $P_1-P_2$ | Cage roll inclination angle α | Occurrence of roll marks | Remarks |
|---|---|---|---|---|---|---|
| | 10 | 100 | −28 | 90.00 | No | No cage roll inclination |
| | 11 | 100 | −32 | 90.00 | No | No cage roll inclination |
| | 12 | 100 | −4 | 90.00 | No | No cage roll inclination |
| Comparative Examples | 1 | 200 | 5 | 90.00 | No | No cage roll inclination |
| | 2 | 200 | 6 | 90.00 | No | No cage roll inclination |
| | 3 | 200 | 104 | 90.00 | No | No cage roll inclination |
| | 4 | 200 | 151 | 90.00 | Yes | No cage roll inclination |
| | 5 | 200 | 38 | 89.43 | Yes | |
| | 6 | 200 | 47 | 89.10 | Yes | |
| | 7 | 200 | 31 | 89.21 | Yes | |
| | 8 | 200 | 111 | 90.00 | Yes | No cage roll inclination |
| | 9 | 200 | 103 | 90.00 | Yes | No cage roll inclination |
| | 10 | 200 | −35 | 90.00 | No | No cage roll inclination |
| | 11 | 200 | −31 | 90.00 | No | No cage roll inclination |
| | 12 | 200 | −6 | 90.00 | No | No cage roll inclination |
| Conventional Examples | 1 | | | 90.00 | No | No cage roll inclination |
| | 2 | | | 90.00 | No | No cage roll inclination |
| | 3 | | | 90.00 | Yes | No cage roll inclination |
| | 4 | | | 90.00 | Yes | No cage roll inclination |
| | 5 | | | 90.00 | Yes | No cage roll inclination |
| | 6 | | | 90.00 | Yes | No cage roll inclination |
| | 7 | | | 90.00 | Yes | No cage roll inclination |
| | 8 | | | 90.00 | Yes | No cage roll inclination |
| | 9 | | | 90.00 | Yes | No cage roll inclination |
| | 10 | | | 90.00 | No | No cage roll inclination |
| | 11 | | | 90.00 | No | No cage roll inclination |
| | 12 | | | 90.00 | No | No cage roll inclination |

According to the conventional method (Conventional Examples) whereby cage rolls are not inclined, roll marks occurred on many rolls. When the reference value B was set to 200 kg (Comparative Examples), roll marks appeared on some rolls. When the reference value B was set to 100 kg (Examples of the Invention), no roll marks occurred, and a high quality steel pipe having a good appearance could be manufactured.

Although the above examples utilized a forming apparatus employing cage rolls, the present invention is not thereby limited, and can be applied in the same manner for a forming apparatus employing cluster rolls.

According to the present invention for a pipe forming apparatus and method, the rotary shaft of a cage roll or a cluster roll is inclined counterclockwise or clockwise on the plane that is formed by the rotational axis and the line direction, so that a load that is applied in the axial direction of the roll is reduced. As a result, roll marks do not occur on the surface of a welded pipe, a beautiful external finish can be provided for the pipe, and the pipe quality can be improved.

Although this invention has been described with reference to specific elements and method steps, equivalent elements and method steps may be substituted, the sequence of method steps may be varied, and certain elements and method steps may be used independently of others. Further, various other elements and control steps may be included, all without departing from the spirit and scope of the invention defined in the appended claims.

What is claimed is:

1. A welded steel pipe manufacturing apparatus into which a steel strip is fed and bent into a pipe configuration by a plurality of forming rolls, said forming rolls being in a position flanking said steel strip and arranged adjacent a direction along which said steel strip is advanced, said apparatus comprising:

angularly adjustable rotary shafts, said shafts being engaged with said forming rolls as rotational axes for said forming rolls;

a load detector positioned to detect load applied to said angularly adjustable rotary shaft;

forming rolls angular adjustment means operably connected to adjust the angle of said angularly adjustable rotary shaft; and a controller connected to control said forming rolls angular adjustment in response to a detected load for selectively angularly adjusting said forming rolls clockwise or counterclockwise substantially within a plane that includes both said forming rolls rotational axis and said direction in which said steel strip is advanced.

2. A welded steel pipe manufacturing apparatus according to claim 1, wherein a plurality of said forming rolls are provided as cage rolls, each of said cage rolls having an upper face and a lower face; and wherein said load detector comprises a first load detector positioned on said upper face and a second load detector positioned on said lower face of each of said cage rolls, said first and second load detectors being constructed to generate signals corresponding to detected loads; and wherein said roll inclination adjustment means comprises a support metal fitting fixed to a rotary shaft, said metal fitting being slidably supported by an arc guide which provides rotational movement of said metal fitting, said metal fitting being connected to said roll rotary shaft;

a motor connected to said rotary shaft through a worm and a worm gear, said motor being connected for rotating said rotary shaft; and wherein said signals transmitted by said first and second load detectors are connected to be processed by said controller.

3. A welded steel pipe manufacturing apparatus according to claim 1, wherein a plurality of said forming rolls are provided as cluster rolls, each of said cluster rolls having an upper face and a lower face;

wherein said load detector comprises a first load detector positioned on said upper face and a second load detector positioned on said lower face of each of said cluster rolls, said first and second load detectors being constructed to generate signals corresponding to detected loads; and wherein said roll inclination adjustment means comprises a support metal fitting fixed to a rotary shaft, said metal fitting being slidably supported by an arc guide which provides rotational movement of said metal fitting, said metal fitting being connected to said roll rotary shaft;

a motor connected to said rotary shaft through a worm and a worm gear, said motor being connected for rotating said rotary shaft; and wherein said signals transmitted by said first and second load detectors are connected to be processed by said controller.

4. A method of manufacturing a welded steel pipe in which steel strip is moved and bent into a pipe configuration by forming rolls, said forming rolls flanking said steel strip in a direction in which said steel strip advances, at least some of said forming rolls having a roll rotary shaft, a rotational axis and a rotational direction, the steps which comprise:

measuring the load that is exerted on said roll rotary shaft of said forming rolls; and inclining said roll rotary shaft of said forming rolls counterclockwise or clockwise in a plane that is formed by said rotational axis of each of said forming rolls and said direction in which said steel strip advances, said inclining step being in an amount to cause said rotational direction substantially to correspond to said direction in which said steel strip advances, thereby minimizing said load.

5. A welded steel pipe manufacturing method according to claim 4, wherein said forming rolls comprise cage rolls, each of said cage rolls having an upper face, a lower face and a rotary shaft.

6. A method according to claim 4, wherein said forming rolls comprise cluster rolls, each of said cluster rolls having an upper face, a lower face and a rotary shaft.

7. A method according to claim 5, wherein said load comprises a detected load $P_1$ on said upper face of each of said cage rolls and a detected load $P_2$ on said lower face of each of said cage rolls, said method further comprising the steps of:

measuring said load $P_1$ and said load $P_2$ through load detectors located about said cage roll rotary shaft;

determining the difference between said load $P_1$ and said load $P_2$;

comparing said difference to a predetermined reference value; and inclining each of said cage rolls counterclockwise or clockwise to substantially match said difference value to said predetermined reference value.

8. A method according to claim 6, wherein said load comprises a load $P_1$ on said upper face of each of said cluster rolls and a load $P_2$ on said lower face of each of said cluster rolls, said method further comprising:

measuring said load $P_1$ and said load $P_2$ through load detectors located about said cluster roll rotary shaft;

determining the difference between said load $P_1$ and said load $P_2$;

comparing said difference to a predetermined reference value; and inclining each of said cluster rolls counterclockwise or clockwise until said difference corresponds to said predetermined reference value.

* * * * *